US006729972B2

(12) United States Patent
Boord

(10) Patent No.: US 6,729,972 B2
(45) Date of Patent: May 4, 2004

(54) PUTTER HEAD DESIGN

(75) Inventor: David J. Boord, Canton, OH (US)

(73) Assignee: Ohio Precision, Inc., Canton, OH (US)

( * ) Notice: Subject to any disclaimer, the term of this patent is extended or adjusted under 35 U.S.C. 154(b) by 0 days.

(21) Appl. No.: 10/074,327

(22) Filed: Feb. 12, 2002

(65) Prior Publication Data

US 2003/0153400 A1 Aug. 14, 2003

(51) Int. Cl.[7] ..... A63B 53/04
(52) U.S. Cl. ..... 473/340; 473/342; 473/349
(58) Field of Search ..... 473/324, 342, 473/340, 341, 332, 349, 350, 329, 251; 273/DIG. 14, DIG. 16

(56) References Cited

U.S. PATENT DOCUMENTS 3,695,618 A * 10/1972 Woolley
4,221,064 A * 9/1980 Sebastian ..... 40/109
4,422,638 A * 12/1983 Tucker
5,083,778 A * 1/1992 Douglass
5,246,227 A * 9/1993 Sun
5,458,332 A * 10/1995 Fisher
5,460,377 A * 10/1995 Schmidt
5,575,472 A * 11/1996 Magerman
5,603,408 A * 2/1997 Protz, Jr. ..... 206/461
5,605,510 A * 2/1997 Schmidt
5,924,939 A * 7/1999 Grace
5,944,619 A * 8/1999 Cameron
5,972,144 A * 10/1999 Hsu
6,083,117 A * 7/2000 Hsu
6,227,986 B1 * 5/2001 Fisher
6,425,831 B1 * 7/2002 Heene
6,441,098 B2 * 8/2002 Halko

* cited by examiner

*Primary Examiner*—Sebastiano Passaniti
(74) *Attorney, Agent, or Firm*—Sand & Sebolt

(57) ABSTRACT

A golf club preferably in the form of a golf putter includes a hard stainless steel club head having a striking surface for contacting a golf ball with a recess formed therein. A softer brass plate and an advertising insert closely fit within the recess, and are covered by transparent epoxy which hardens to form a portion of the striking surface through which advertising printed on the insert is visible. The club head further includes a rear recess behind the front recess, between which is defined a thin perforated wall. The stainless steel body, the brass plate, the transparent epoxy, and the perforated wall provide a golf putter which has a large sweet spot and which provides for advertising.

19 Claims, 5 Drawing Sheets

PUTTER HEAD DESIGN

BACKGROUND OF THE INVENTION

1. Technical Field

The present invention relates generally to golf clubs, and more particularly to golf putters having heads which utilize inserts to provide the desired putting characteristics for the putter. Specifically, the invention relates to a putter head with a clear plastic insert on the face thereof, which may have a advertising indicia behind the insert.

2. Background Information

Golf is a sport which has provided a challenge for people for years due to the unique combination of finesse and strength required to play the game well. To stay at the top of one's game, professional golfers play many rounds of golf per week. However, most golfers play golf only for fun such as on weekends and their golf game suffers due to the relatively infrequent play. Consequently, such weekend golfers have sought improved golf clubs and golf balls which are more forgiving of errors in their golf swing.

A variety of golf clubs have been devised over the years in an attempt to make the clubs more forgiving of errors during their golf swing and in general during play. One area of focus has been on golf putters since a high percentage of the strokes in a round of golf occur after the golf ball has been hit onto the green (i.e. during putting). A variety of different style golf putters have thus been developed to aid the golfer during putting such as various lines on the golf ball striking surface and the top of the putter head to help the golfer align the golf ball striking surface with the hole in the green. Also, putters have been designed which are more forgiving to improper putting strokes, having a larger so called "sweet spot", wherein the putter head contacts the golf ball without significant twisting which causes the golf ball to travel off course. This typically involves the placement and distribution of the mass of the putter head behind the golf ball striking surface thereof.

The range of golf putter designs is limited only by the imagination of the putter designer. Attempts include a variety of shapes for the body of the putter head, various alignment lines on the body, various angles for the golf ball striking surface, and various materials or inserts incorporated into the golf ball striking surface to alter the rebound characteristics of the golf ball when contacted during putting. While some of these putter designs have made improvements in the forgiveness of the putter and enlarged the sweet spot, they still lack a truly large sweet spot. Furthermore, golf putters lack any effective form of advertising to promote the golf club, or for other paid advertisers to promote their product or service, except in the form of advertising indicia which is on an adhesive label applied to the club or which is cast into metal club heads during club head manufacture. Such labels do not give a professional look to the golf club, and the cast-in variety require more complex casting molds and shorter casting runs, increasing the cost to produce the golf clubs.

There is thus, a continuing need for golf clubs and in particular golf putters which overcomes the number of problems associated with the prior art.

SUMMARY OF INVENTION

One of the advantages of the present invention is that it provides a golf putter which is forgiving of imperfectly stroked putts by having an enlarged sweet spot.

A further advantage of the present invention is that it provides a method for advertising while the putter is used or otherwise displayed.

These and other advantages of the present invention may be realized by reference to the remaining portions of the specification, claims, and abstract.

BRIEF SUMMARY OF THE INVENTION

The present invention relates to a putter head for a golf putter, a golf club for advertising, and a method of advertising using the golf club. The putter head is for a golf putter of the type having an elongate shaft with a hand grip connected to a gripping end thereof and a putter head attachment end. The putter head includes an elongate body having a heel adapted for attachment to the putter attachment end and a toe. A striking face extends along the body with a front recess formed in the striking face. The front recess has a bottom surface. The putter head further includes a plastic insert of mating configuration to the front recess which is disposed in the front recess. An outside surface of the plastic insert is substantially coplanar with the striking face forming a golf ball striking surface.

The golf club for advertising includes an elongate shaft having a gripping end and a club head attachment end, with a hand grip connected to the gripping end of the shaft. The golf club further includes a club head having a body with a heel adapted for attachment to the club head attachment end, and having a toe. A golf ball striking surface extends along the body with a front recess formed in the striking face having a bottom surface. A transparent plastic insert of mating configuration to the front recess is disposed in the front recess. An outside surface of the plastic insert is substantially coplanar with the striking face forming a golf ball striking surface. An advertising indicia is visible through the plastic insert.

The method of advertising comprises the steps of 1) providing a golf club of the type having an elongate shaft with a hand grip connected to a gripping end thereof and a club head attachment end, a club head which includes a body having a recess formed therein, a plastic insert of mating configuration to the recess disposed in the recess, and an advertising indicia which is visible through the plastic insert; and 2) displaying the advertising indicia to persons such as by using the golf club to play golf.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE SEVERAL VIEWS OF THE DRAWINGS

Preferred embodiments of the present invention are shown in the accompanying drawings wherein.

DETAILED DESCRIPTION OF THE INVENTION

Figure 1:
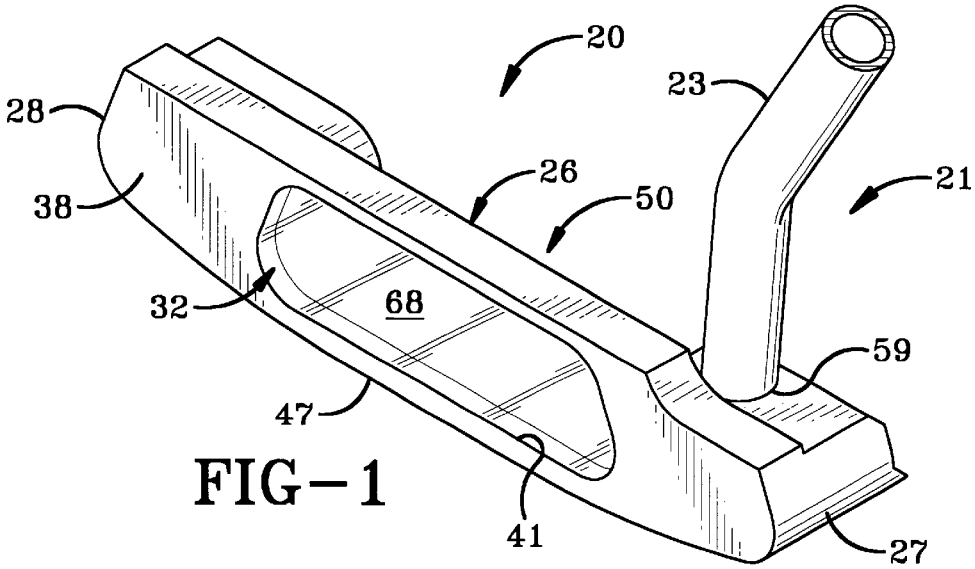
FIG. 1 is a fragmentary perspective view of a first illustrative embodiment putter head constructed in accordance with the present invention, as part of a first golf putter.
Figure 3:
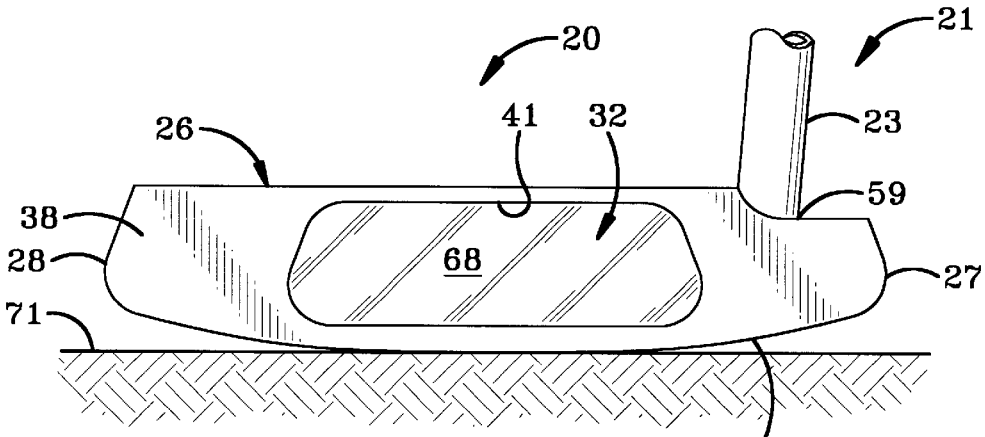
FIG. 3, a fragmentary front elevational view of the first illustrative embodiment putter head of the first golf putter.

Referring to FIGS. 1–6, there is shown a first illustrative embodiment putter head in accordance with the present invention, designated generally at 20, as part of a golf putter 21 (only the putter shaft 23 thereof also being visible).

The putter head 20 comprises a hard stainless steel body 26 (preferably 304 stainless steel, about 4.750×1.000×0.990 inches in outside dimensions, and weighing 9.5 ounces) having a heel 27 and a toe 28, a metal insert in the form of a soft metal or brass plate 29 (preferably 36000 brass), and an epoxy resin or plastic insert 32, preferably of poured and hardened transparent or opaque epoxy resin. One suitable two-part resin with catalyst being sold under the trade name Devcon™ 14251, Clear Shore A 67 hardness by Devcon of Danvers, Mass. The body 26 includes a striking face 38 with a front recess 41 therein, a curved ground-contacting lower surface 47, and a rear recess 50. The putter shaft 23 is affixed within a bore 59 at the heel 27 of the body 26. A plurality of holes 62 extend through a front wall 53 between the front recess 41 and the rear recess 50. The holes 62 are typically between about 0.100 to 0.150 inch in diameter, preferably 0.125 inch. The front wall 53 is typically between about 0.100 to 0.125 inch thick, preferably 0.113 inch thick. The brass plate 29 is of such a configuration as to closely fit within the front recess 41, and can be adhesively secured to a bottom surface 65 of the front recess 41. The brass plate 29 is preferably 2.500 wide×0.750 high×0.125 thick, weighing about one ounce. The liquid Devcon™ resin is mixed with the catalyst and poured into the front recess 41 over the brass plate 29 to seal the putter head 20. A planar golf ball striking surface 68 is then formed by grinding and polishing of the body 26 and the plastic insert 32 following curing of the resin.

Figure 4:
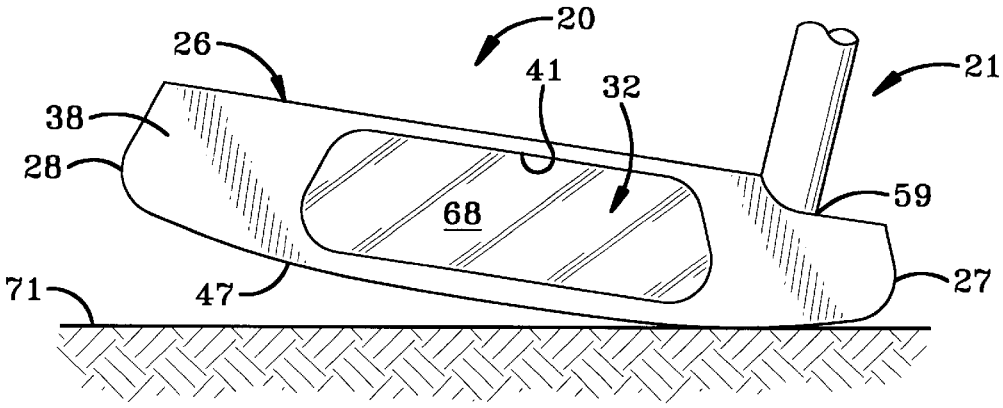
FIG. 4, a fragmentary front elevational view corresponding to FIG. 2, but with the first illustrative embodiment putter head tilted longitudinally onto the heel.
Figure 2:
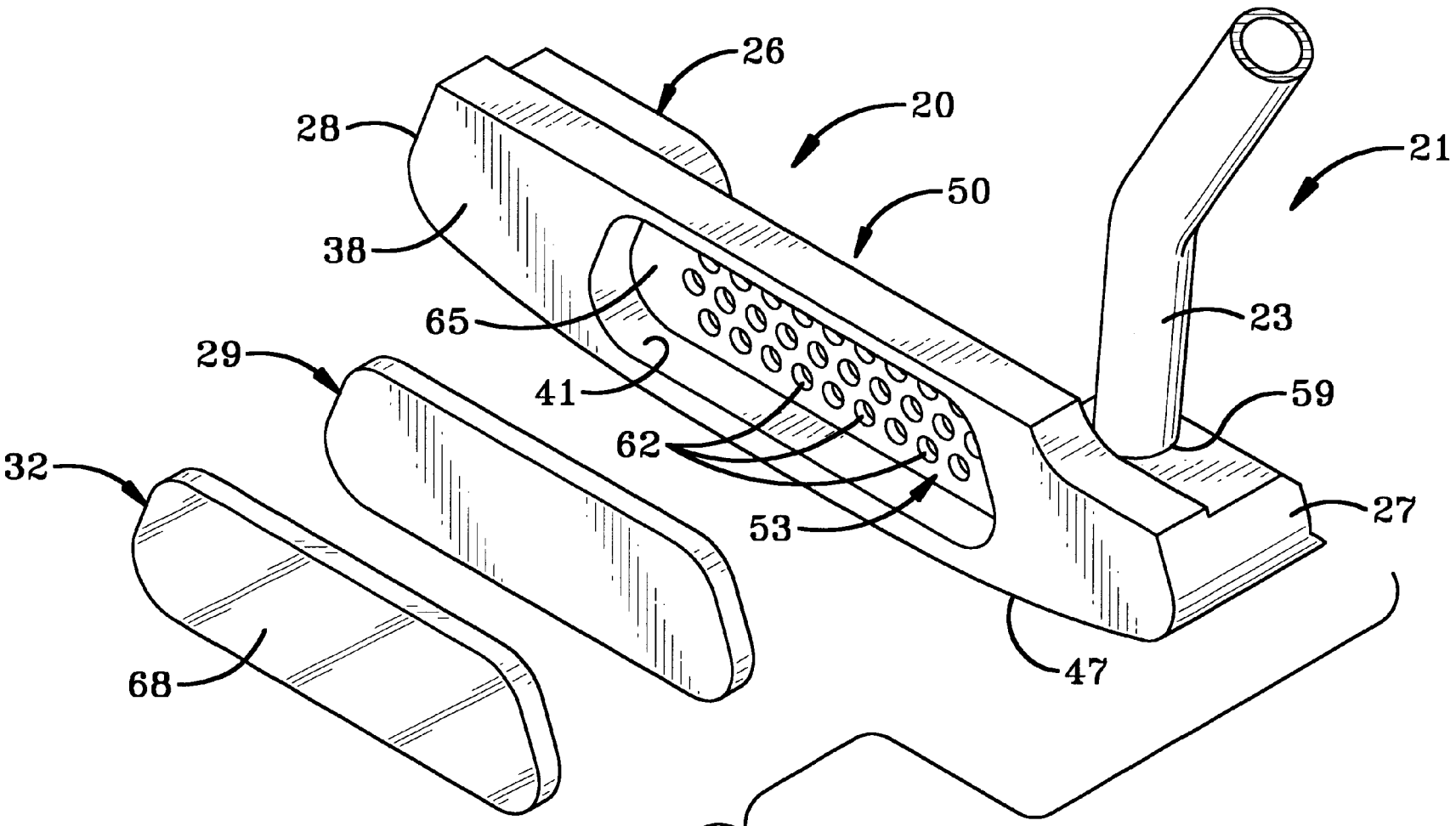
FIG. 2, a fragmentary exploded perspective view of the first illustrative embodiment putter head of the first golf putter.
Figure 5:
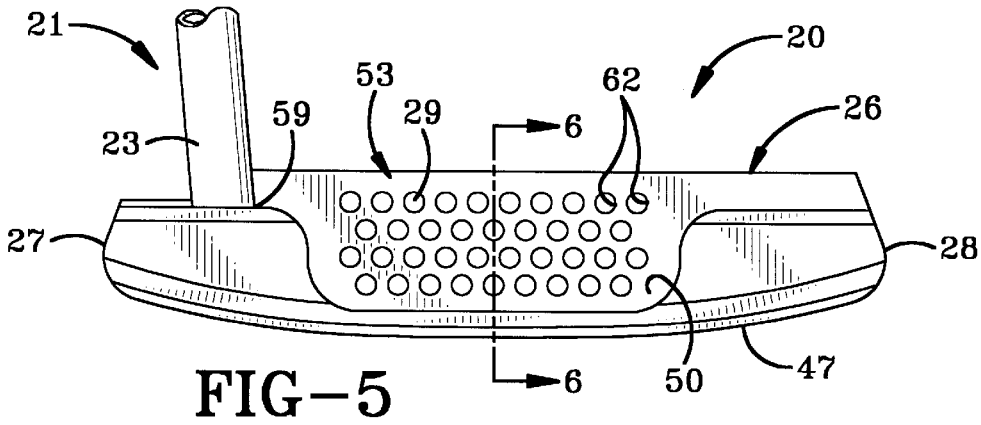
FIG. 5, a fragmentary rear elevational view of the first illustrative embodiment putter head of the first golf putter.
Figure 6:
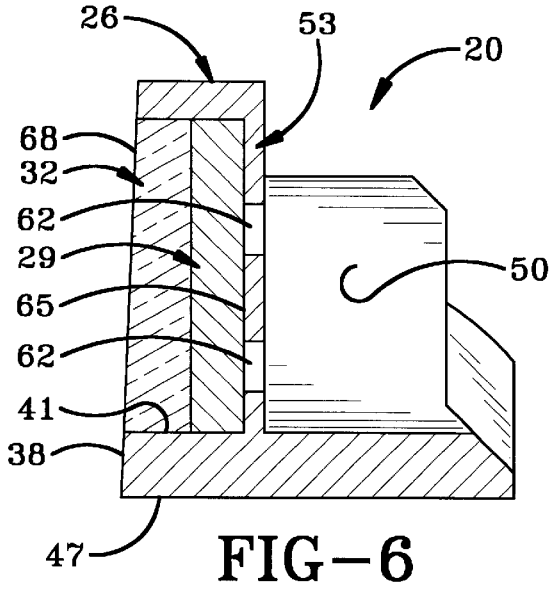
FIG. 6, a lateral vertical cross-sectional view taken on the line 6—6 of FIG. 5.
Figure 10:
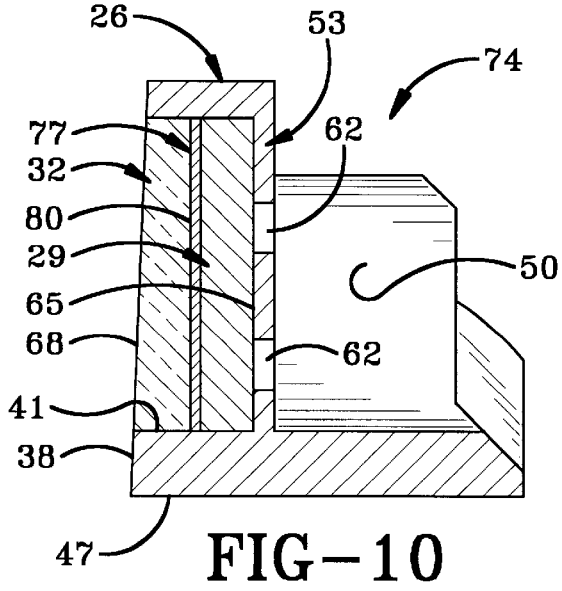
FIG. 10, a lateral vertical cross-sectional view taken on the line 10—10 of FIG. 9.
Figure 7:
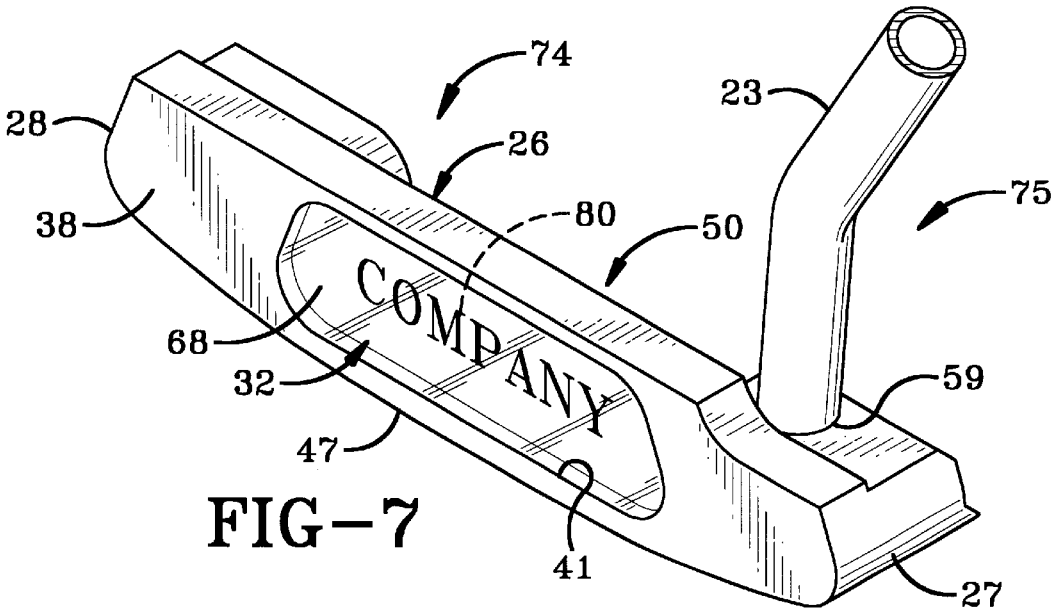
FIG. 7, a fragmentary perspective view of a second illustrative embodiment putter head constructed in accordance with the present invention, as part of a second golf putter.
Figure 9:
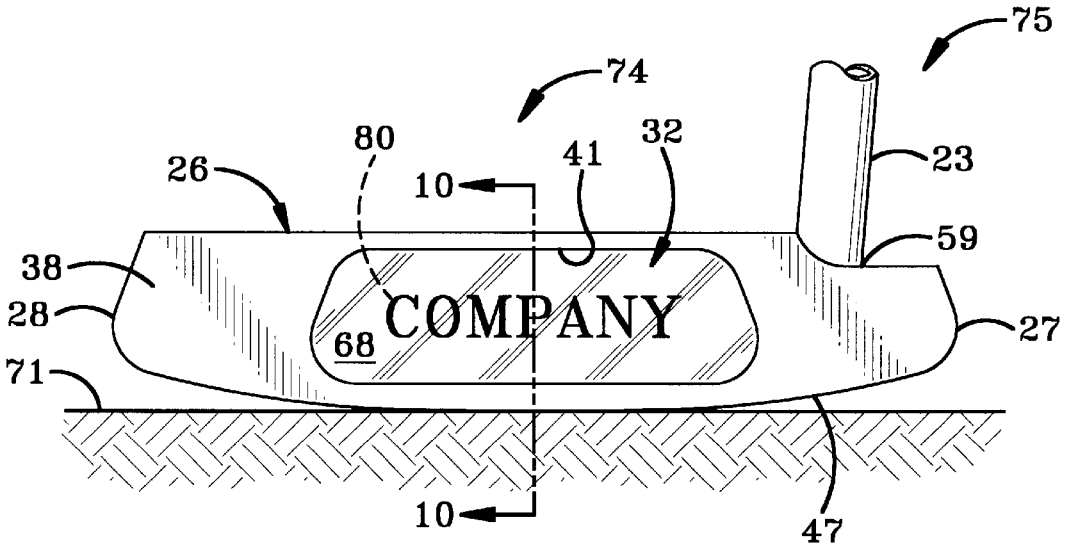
FIG. 9, a fragmentary front elevational view of the second illustrative embodiment putter head of the second golf putter.

The putter head 20 is unique in its design in that it provides for a larger sweet spot as well as for a softer impact on the golf ball striking surface. This is due to the configuration of utilizing a hard stainless steel body 26 to provide mass at the heel 27 and the toe 28 of the putter head 20 during the putting stroke, in combination with more resilient soft brass plate 29, the plastic insert 32, and the reduced mass and increased flexibility at the thin front wall 53 where the putter head 20 contacts the golf ball. The curved lower surface 47 of the body 26 permits tilting of the putter 21 relative to the ground 71 to suit the individual golfer (FIG. 4).

Referring to FIGS. 7–10, therein is shown a second illustrative embodiment putter head in accordance with the present invention, designated generally at 74, as part of a golf putter 75 (only the putter shaft 23 also being visible).

Figure 8:
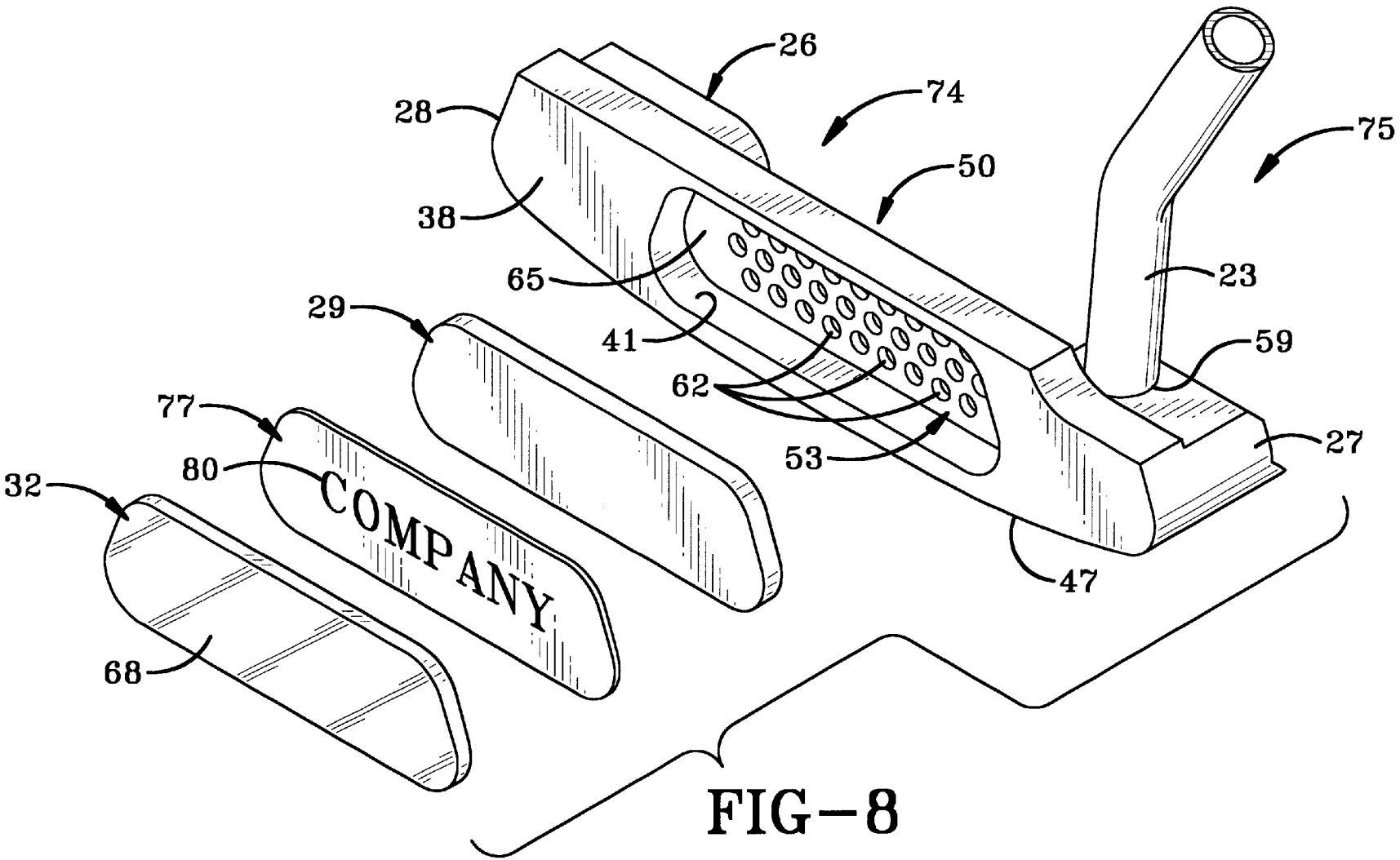
FIG. 8, a fragmentary exploded perspective view of the second illustrative embodiment putter head of the second golf putter.

The putter head 74 comprises the stainless steel body 26, the brass plate 29, and the plastic insert 32. Referring to FIG. 8, an advertising insert 77 having printed advertising indicia 80 is adhesively secured to the brass plate 29. The transparent liquid Devcone™ material is poured into the front recess 41 over the advertising insert 77 and the brass plate 29 to seal the putter head 20. The planar golf ball striking surface 68 is then formed by grinding and polishing of the body 26 and the plastic insert 32 following curing of the resin. The printed advertising indicia 80 on the advertising insert 77 is visible through the plastic insert 32 from in front of the putter head 74 and be manufactured of thin plastic or paper.

The putter heads 20 and 74 as part of the respective golf putters 21 and 75 can be used for advertising. While the putter head 74 is used primarily for use in advertising, the putter head 20 can be adapted for advertising by printing advertising indicia onto the brass plate 29 or onto the plastic insert 32. The method of advertising comprising the steps of providing a golf club of the type having an elongate shaft with a hand grip connected to a gripping end thereof and a club head attachment end, and a club head. These can be putters, irons, or woods. The club head includes a body having a recess formed therein, a plastic insert of mating configuration to the recess disposed in the recess, and an advertising indicia which is visible through the plastic insert. The advertising is displayed to persons such as by using the golf club to play golf.

It can now be seen that the present invention solves many of the problems associated with the prior art. The present invention provides a golf putter which is forgiving of imperfectly stroked putts by having an enlarged sweet spot. The present invention also provides a method for advertising while the putter is used or otherwise displayed.

Although the description above contains many specifications, these should not be construed as limiting the scope of the invention but as merely providing illustrations of some of presently preferred embodiments of this invention. The specification, for instance, makes reference to a poured plastic insert in the form of a two-part epoxy (resin and catalyst) of a hardness of Shore A 67. However, the present invention is not intended to be limited to use with poured epoxy or other poured plastic inserts, nor of that exact hardness. Rather it is intended that the present invention can be easily adapted for use with solid plastic inserts or inserts made of other materials which are adhesively or otherwise secured to the putter body. The hardness of the plastic inserts is typically of a Shore A between about 62 and 72, though other hardnesses are possible. Likewise, while a putter is used as illustrative of the invention, the advertising aspect of the present invention can be adapted to any golf club including woods and irons. Thus, the scope of the invention should be determined by the appended claims and their legal equivalents rather than by the examples given.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A putter head for a golf putter of the type having an elongate shaft with a hand grip connected to a gripping end thereof and a putter head attachment end, comprising:

an elongate body having a heel adapted for attachment to the putter attachment end, a toe, a golf ball striking face extending along the body, and a front recess formed in the striking face, the recess having a bottom surface;

a transparent plastic insert of mating configuration to the front recess disposed in the front recess and having an outside surface which is substantially coplanar with the striking face to form a golf ball striking surface; and an advertising insert containing advertising indicia which is visible through the plastic insert.

2. The putter head according to claim 1 wherein the advertising insert is manufactured of one of paper or plastic.

3. The putter head according to claim 1 wherein the plastic insert comprises an epoxy resin which has been introduced into the front recess and cured.

4. The putter head according to claim 3 wherein the outside surface of the plastic insert and the striking face of the body are substantially coplanar to form a golf ball striking surface by being ground after curing of the epoxy resin.

5. The putter head according to claim 3 wherein the epoxy resin is of a Shore A hardness of between about 62 and 72.

6. The putter head according to claim 1 wherein the plastic insert occupies at least fifty percent of a total area of the golf ball striking surface, said plastic insert having a Shore A hardness in the range of between about 62 to 72.

7. The putter head according to claim 6 wherein the body includes a rear recess of a longitudinal length and height generally the same as the front recess, defining a vertical wall therebetween.

8. The putter head according to claim 7 wherein the vertical wall is of a substantially constant thickness of between about 0.100 to 0.125 inch.

9. The putter head according to claim 7 wherein a plurality of holes extend through the vertical wall to comprise a perforated wall.

10. The putter head according to claim 9 wherein the holes include an end portion which is enlarged in a manner chosen from the set consisting of countersunk and counterbored.

11. The putter head according to claim 9 wherein the vertical wall is of a substantially constant thickness of between about 0.100 to 0.125 inch.

12. The putter head according to claim 11 wherein the body is made of stainless steel.

13. The putter head according to claim 12 wherein the holes include an end portion which is enlarged in a manner chosen from the set consisting of countersunk and counterbored.

14. The putter head according to claim 12 wherein the body includes a longitudinally upwardly curved lower surface.

15. The putter head according to claim 1 wherein the body is made of 304 stainless steel and the metal plate is made of 36000 brass.

16. A putter head for a golf putter of the type having an elongate shaft with a hand grip connected to a gripping end thereof and a putter head attachment end, comprising:

an elongate body having a heel adapted for attachment to the putter attachment end, a toe, a golf ball striking face extending along the body, and a front recess formed in the striking face, the recess having a bottom surface;

a transparent plastic insert of mating configuration to the front recess disposed in the front recess and having an outside surface which is substantially coplanar with the striking face to form a golf ball striking surface;

a metal plate of mating configuration to the front recess being disposed in said front recess between the bottom surface of said front recess and the plastic insert; and an advertising insert containing advertising indicia which is visible through the plastic insert.

17. The putter head according to claim 16 wherein the advertising insert is manufactured of one of paper or plastic.

18. A golf club for advertising, comprising:

an elongate shaft having a gripping end and a club head attachment end;

a hand grip connected to the gripping end of the shaft;

a club head comprising:

a body having a heel adapted for attachment to the club head attachment end, a toe, a golf ball striking face extending along the body, and a front recess formed in the striking face, the recess having a bottom surface;

a transparent plastic insert of mating configuration to the front recess disposed in the front recess and having an outside surface which is substantially coplanar with the striking face to form a golf ball striking surface; and an advertising insert containing advertising indicia which is visible through the plastic insert.

19. The golf club according to claim 18 wherein the plastic insert occupies at least fifty percent of a total area of the golf ball striking surface, said plastic insert having a Shore A hardness in the range of between about 62 and 72.

* * * * *